US008363080B2

(12) United States Patent
Shin

(10) Patent No.: US 8,363,080 B2
(45) Date of Patent: Jan. 29, 2013

(54) MULTI-BEAM IMAGE FORMING APPARATUS AND IMAGE FORMING METHOD USING THE SAME

(75) Inventor: Sang-Youn Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 48 days.

(21) Appl. No.: 12/692,736

(22) Filed: Jan. 25, 2010

(65) Prior Publication Data

US 2010/0128101 A1 May 27, 2010

Related U.S. Application Data

(63) Continuation of application No. 11/294,494, filed on Dec. 6, 2005, now Pat. No. 7,667,725.

(30) Foreign Application Priority Data

Apr. 26, 2005 (KR) ..... 2005-34654

(51) Int. Cl.
*B41J 2/435* (2006.01)

(52) U.S. Cl. ..... 347/229; 347/234; 347/248

(58) Field of Classification Search ..... 347/234, 347/237, 239, 229, 248
See application file for complete search history.

(56) References Cited

U.S. PATENT DOCUMENTS

| | | | | |
|---|---|---|---|---|
| 4,578,689 | A | 3/1986 | Spencer et al. | |
| 5,300,962 | A | 4/1994 | Genovese | |
| 5,987,193 | A * | 11/1999 | Eguchi et al. | 382/318 |
| 6,038,051 | A | 3/2000 | Suzuki et al. | |
| 2004/0066423 | A1 | 4/2004 | Samii | |
| 2004/0141051 | A1 * | 7/2004 | Tsuruya | 347/239 |
| 2004/0183891 | A1 * | 9/2004 | Ishida et al. | 347/239 |
| 2004/0239747 | A1 | 12/2004 | Maeda | |
| 2006/0132880 | A1 * | 6/2006 | Amada et al. | 359/196 |

FOREIGN PATENT DOCUMENTS

| | | |
|---|---|---|
| JP | 7/242019 | 9/1995 |
| JP | 2004-126482 | 4/2004 |
| JP | 2004-223754 | 8/2004 |
| KR | 1999-0049598 | 7/1999 |

* cited by examiner

*Primary Examiner* — Stephen Meier
*Assistant Examiner* — Sarah Al Hashimi
(74) *Attorney, Agent, or Firm* — Stanzione & Kim, LLP

(57) ABSTRACT

A multi-beam image forming apparatus and a method using the same. The image forming apparatus includes: an image process module to divide first image data into a plurality of second image data; a light scanning unit to scan the plurality of second image data using a plurality of laser beams; and a controller to control the formation of an electrostatic latent image of the first image data on a photosensitive body in an overlapping manner, using at least two of the plurality of laser beams.

13 Claims, 11 Drawing Sheets

MULTI-BEAM IMAGE FORMING APPARATUS AND IMAGE FORMING METHOD USING THE SAME

CROSS-REFERENCE TO RELATED APPLICATIONS

This application is a continuation application of prior application Ser. No. 11/294,494, filed Dec. 6, 2005 now U.S. Pat. No. 7,667,725, in the claims U.S. Patent and Trademark Office, now pending, which claims priority from Korean Patent Application No. 2005-34654, filed Apr. 25, 2005, the disclosure of which is hereby incorporated herein by reference in its entirety.

BACKGROUND OF THE INVENTION

1. Field of the Invention

The present general inventive concept relates to an image forming apparatus and image forming method, and more particularly, to a multi-beam image forming apparatus and a method of forming an image using the same.

2. Description of the Related Art

An image forming apparatus such as a laser printer, a digital copier, etc., includes a laser scanning unit to emit a laser beam that forms an electrostatic latent image on a photosensitive body.

The laser beam emitted from a semiconductor laser located in the laser scanning unit is reflected by a polygonal mirror onto a photosensitive body moving with a predetermined speed. As the polygonal mirror rotates, the reflected laser beam scans a direction (main-scanning direction) perpendicular to the moving direction (sub-scanning direction) of the photosensitive body. The laser beam is modulated corresponding to the input image so that the corresponding electrostatic latent image is formed on the photosensitive body.

Recently, a multi-beam image forming apparatus using a light scanning unit having a plurality of laser beams has been developed in order to increase the printing speed. When the light scanning unit includes only one laser beam, one main-scanning line is formed on the photosensitive body during the scanning process in the sub-scanning direction. When the light scanning unit includes a plurality of laser beams, the laser beams form a plurality of lines on the photosensitive body during the scanning process in the sub-scanning direction. Therefore, the printing speed of the multi-beam image forming apparatus is much higher than that of a single beam image forming apparatus. An example of the multi-beam image forming apparatus is disclosed in Korean Patent Laid-open Publication No. 1999-49598.

In addition to increasing the printing speed, various methods for improving resolution using a multi-beam image forming apparatus have been proposed. A multi-beam image forming apparatus for improving resolution is disclosed in Japanese Patent Laid-open Publication No. 2004-223754, entitled "Image Forming Apparatus", filed by Tsuruya. According to Tsuruya, overlapping laser beams are applied sequentially in different main-scanning directions. The respective laser beams are scanned onto the photosensitive body in a dot shape having a certain size, and the dots overlap to thereby improve resolution.

However, it is difficult to precisely control the time intervals between scanning in different main-scanning directions with the plurality of laser beams. The printing speed decreases when this method is used to improve the resolution, since it is time-consuming for the plurality of laser beams to be scanned to form one main-scanning line,

SUMMARY OF THE INVENTION

The present general inventive concept provides a multi-beam image forming apparatus and method capable of improving resolution.

The foregoing and/or other aspects of the present general inventive concept are achieved by providing an image forming apparatus including: an image process module to divide first image data into a plurality of second image data; a light scanning unit to scan the plurality of second image data using a plurality of laser beams; and a controller to control the formation of an electrostatic latent image of the first image data on a photosensitive body, using at least two of the plurality of laser beams.

The image process module may divide the first image data into the second image data according to addresses of the first image data. The controller may use either pulse width modulated signals or pulse amplitude modulated signals to control laser beam.

The foregoing and other aspects of the present general inventive concept may also be achieved by providing an image forming apparatus including a light scanning unit to emit n laser beams to scan a surface of a photosensitive body in a main-scanning direction; a photosensitive body controller to move the photosensitive body to allow the n laser beams to scan the surface of a photosensitive body in a sub-scanning direction; an image process module to divide high-resolution image data having a resolution n-times higher than a medium resolution into n medium-resolution image data; and a controller to control the photosensitive body controller and the light scanning unit comprising n laser beams to form in an overlapping manner a high-resolution latent electrostatic image on the surface of the photosensitive body, from the n medium-resolution image data.

The photosensitive body controller may move the photosensitive body in the sub-scanning direction by a distance corresponding to the one main-scanning line, and the n medium-resolution image data may correspond to the n laser beams, respectively.

The laser beams may overlap each other n times in the one main-scanning line and may overlap in a sequential manner.

The high-resolution image data may be divided into n medium-resolution image data according to one cycle of a video clock of the medium-resolution image data.

The foregoing and other aspects of the present general inventive concept may also be achieved by providing an image forming method including dividing first image data into a plurality of second image data; and modulating the second image data to generate image signals and scanning the signals through a plurality of laser beams with at least two laser beams overlapping each other, to form an electrostatic latent image of the first image data.

The foregoing and other aspects of the present general inventive concept may also be achieved by providing an image forming method including receiving a high-resolution image data having a resolution n-times higher than a medium resolution; dividing and converting the high-resolution image data into n medium-resolution image data; modulating the medium-resolution image data to pulse width signals; and scanning n laser beams modulated by the pulse width or pulse amplitude signals a photosensitive body to form an electrostatic latent image of the high-resolution image data on the photosensitive body, in an overlapping manner.

The foregoing and other aspects of the present general inventive concept may also be achieved by providing an image forming apparatus comprising a controller that controls a light scanning unit that emits at least two laser beams modulated according to groups of data to form an electrostatic latent image on a surface of a rotating photosensitive body in an overlapping manner, and an image process module to divide image input data into n groups of data used to modulate the at least two laser beams, where n is an integer equal to the number of available lasers.

The foregoing and other aspects of the present general inventive concept may also be achieved by providing a multi-beam image forming apparatus capable of processing input image data with different resolutions comprising a light scanning unit to emit n laser beams to scan a surface of a photosensitive body in a main-scanning direction, an image process module to divide high resolution image data having a resolution m-times higher than a medium resolution into medium resolution image data (m<n), and a controller to control the movement of the photosensitive body to cause the laser beams to scan in a sub-scanning direction and in an overlapping manner to form a latent electrostatic image on the surface of the photosensitive body, using the medium-resolution image data.

The foregoing and other aspects of the present general inventive concept may also be achieved by providing an image forming method including receiving a high-resolution image data having a resolution n-times higher than a medium resolution, dividing the high-resolution image data into n-medium resolution image data, modulating the n medium resolution image data to generate pulse amplitude signals, and emitting n laser beams modulated by pulse amplitude signals, and emitting n laser beams modulated by the pulse amplitude signals to form on a photosensitive body an electrostatic latent image corresponding to the high-resolution image data.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
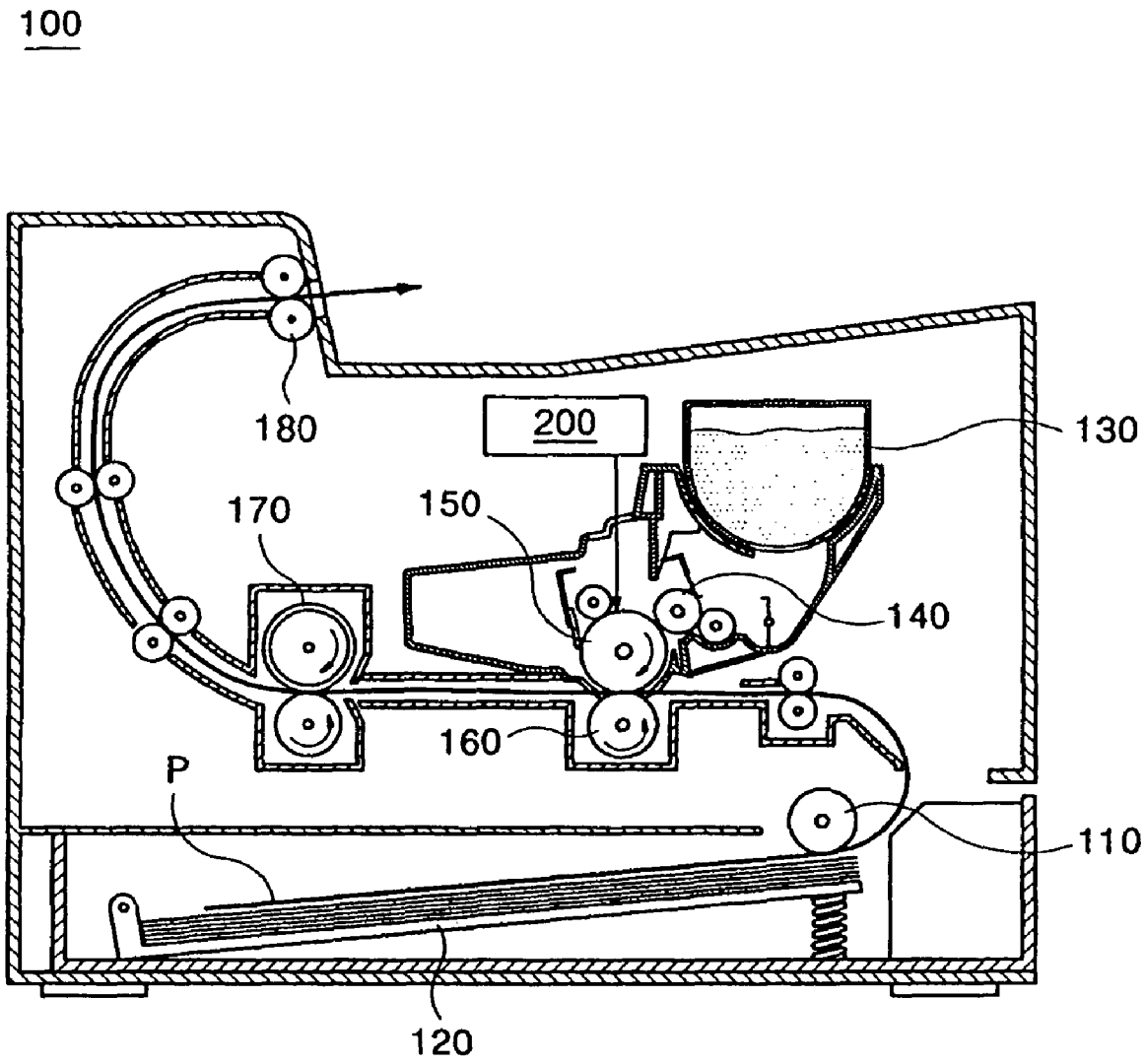
FIG. 1 is a schematic diagram of an image forming apparatus in accordance with an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a schematic diagram of an image forming apparatus 100 in accordance with an embodiment of the present general inventive concept.

Referring to FIG. 1, an image forming apparatus 100 records input image data on a recording medium P. When the image forming apparatus receives input image data, the recording medium P is supplied from a tray 120 by a pickup roller 110. A light scanning unit 200 forms an electrostatic latent image corresponding to the input image data on a surface of a photosensitive body 150 using a plurality of laser beams. A toner supplied by a toner cartridge 130 is deposited by a developing roller 140 on the photosensitive body 150 on which the electrostatic latent image is formed to develop a toner image. The toner image is transferred to the recording medium P by a transfer roller 160. The transferred image is fixed onto the recording medium P by passing through a fixing roller 170. The recording medium P containing the transferred and fixed toner image is discharged through an exit roller 180.

Figure 2:
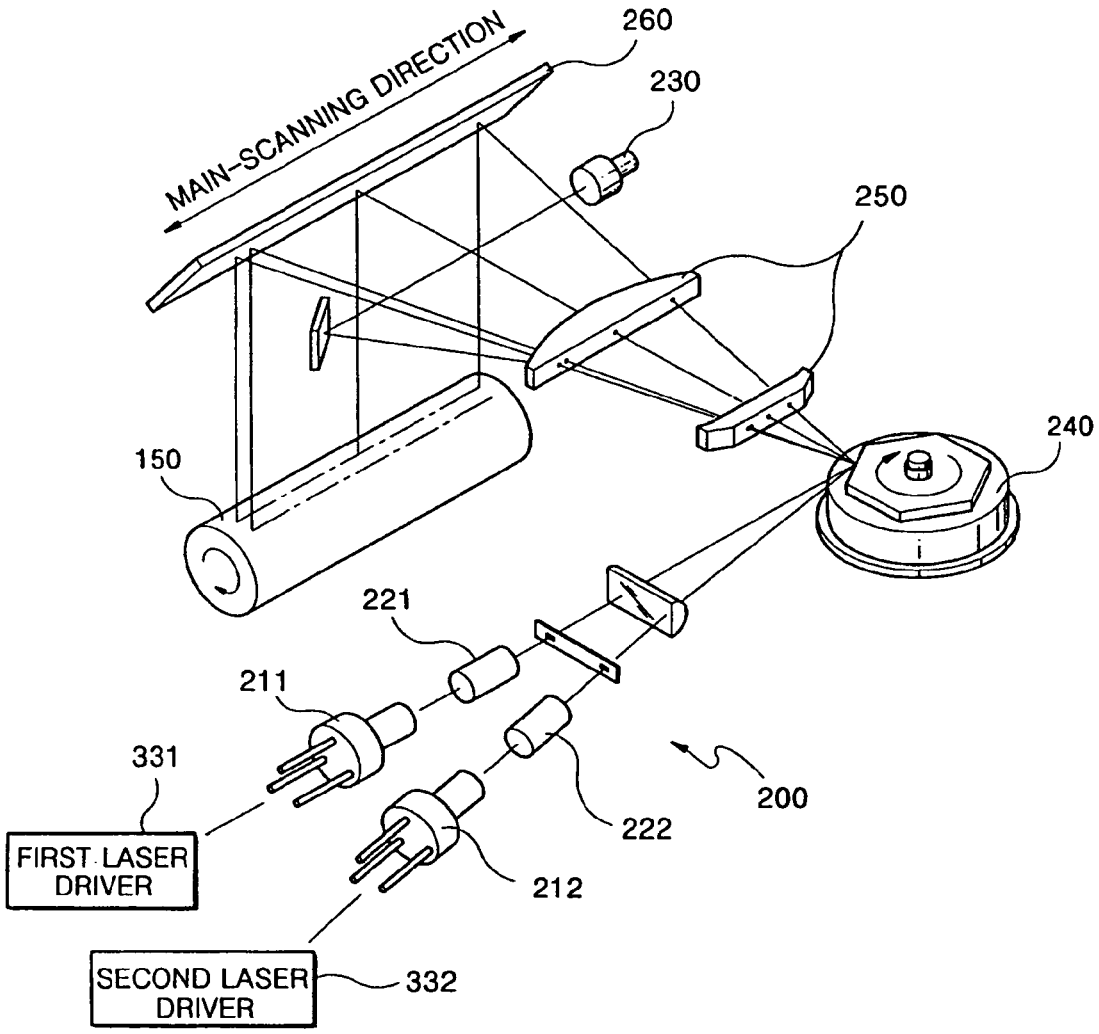
FIG. 2 is a schematic diagram of a light scanning unit of the image forming apparatus shown in FIG. 1.

FIG. 2 is a schematic diagram of the light scanning unit 200 of the image forming apparatus shown in FIG. 1.

Referring to FIG. 2, the light scanning unit 200 includes semiconductor lasers 211 and 212, collimating lenses 221 and 222, a polygonal mirror 240, and an optical system 250.

The two semiconductor lasers 211 and 212 are individually controlled by respective laser drivers 331 and 332. FIG. 2 illustrates the two semiconductor lasers emitting two laser beams, but alternative embodiments may include three or more semiconductor lasers. In addition, a semiconductor laser array capable of emitting multiple laser beams may be used instead of the multiple semiconductor lasers.

The collimating lenses 221 and 222 collimate the laser beams emitted from the respective semiconductor lasers 211 and 212 in parallel beams or beams converging to an optical axis. The laser beams passing through the collimating lenses 221 and 222 are deflected by the polygonal mirror 240. After passing through the optical system 250, the deflected laser beams are reflected by a mirror 260 and scanned onto the surface of the photosensitive body 150.

Figure 3:
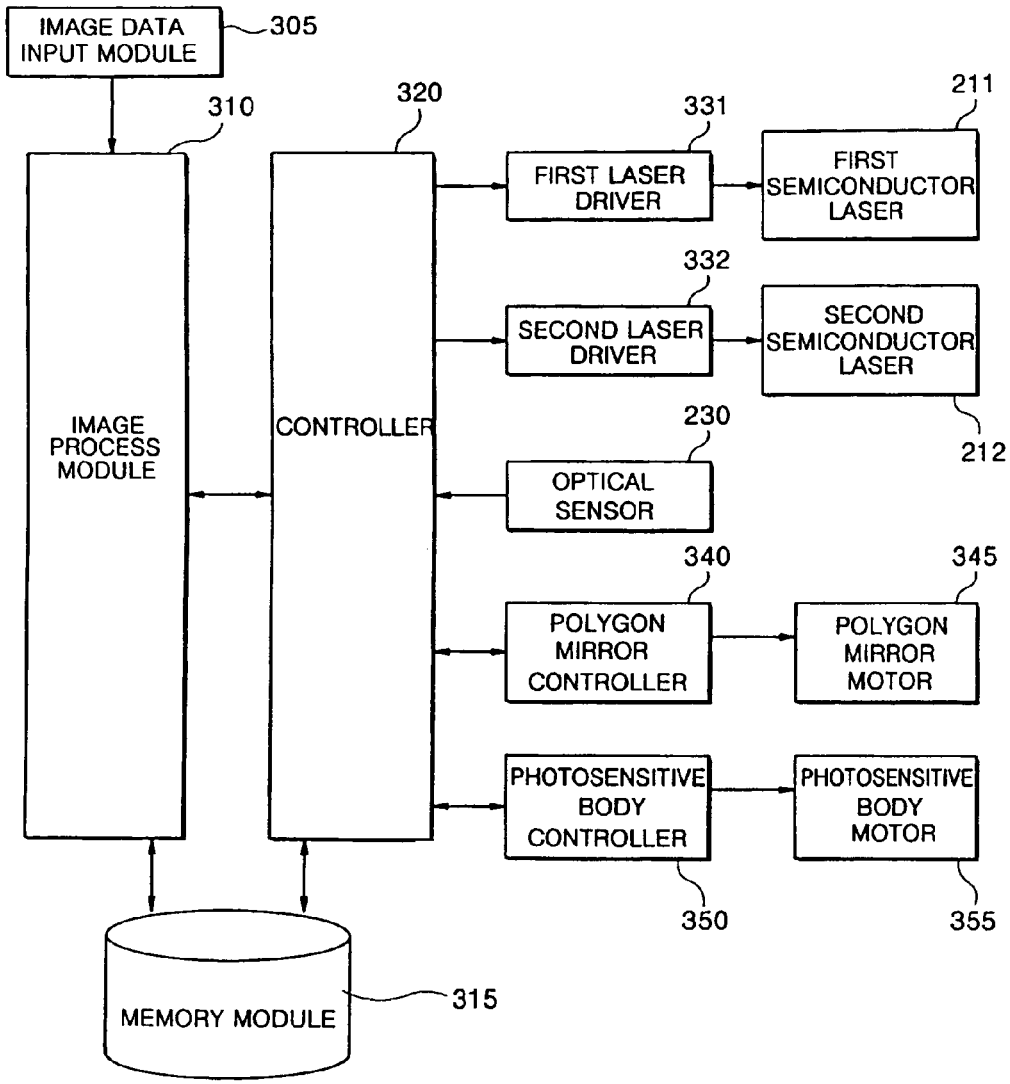
FIG. 3 is a block diagram of the image forming apparatus of FIG. 1.

The polygonal mirror 240 is rotated by a polygonal mirror motor 345 (see FIG. 3). The incident laser beams are deflected at continuously varying angles according to rotation of the polygonal mirror 240. Generally, one scan is performed in the main-scanning direction for each surface of the polygonal mirror 240.

Two laser beams are projected to be incident on the surface of the photosensitive body 150 in a direction (sub-scanning direction) perpendicular to the main-scanning direction. When one scan is performed in the main-scanning direction while the polygonal mirror 240 rotates, two main-scanning lines are formed on the surface of the photosensitive body 150 by the two laser beams. If four laser beams are used, these beams may form four main-scanning lines in the sub-scanning direction, during one scan.

An optical sensor 230 is used to initialize a scanning in the main-scanning direction. The optical sensor 230 synchronizes the arrival of the laser beams with the scanning of the photosensitive body 150. In other words, when the optical sensor detects the laser beams, the optical sensor initiates the scanning of the surface of the photosensitive body 150 at a proper time. Generally, the optical sensor 230 is installed at [the] a periphery of a scanning region to detect the laser beam when the beam arrives there. Scanning does not begin before a predetermined time passes after the optical sensor 230 detects the laser beam.

FIG. 3 is a block diagram of the image forming apparatus 100 shown in FIG. 1.

Referring to FIG. 3, an image data input module 305 receives input image data from a host computer (not shown), a scanner (not shown), or the like. An image process module 310 divides the input image data into a plurality of line data and stores the plurality of line data in a memory module 315. One line data contains information for one main-scanning line. In addition, the memory module 315 can store a lookup table to convert the line data into a pulse width modulation signal. A controller 320 controls overall operation of the image forming apparatus 100, reads the line data from the memory module 315, and converts it into an image signal using the lookup table. In the present embodiment, the image signal is a pulse width modulation (PWM) signal. Alternatively, the image signal may be a pulse amplitude modulation (PAM) signal.

Laser drivers 331 and 332 modulate laser beams emitted from the respective semiconductor lasers 211 and 212 according to the PWM signal generated by the controller 320. That is, the laser drivers 331 and 332 turn the respective semiconductor lasers 211 and 212 on/off according to the PWM signal. As the semiconductor lasers 211 and 212 are turned on/off, an electrostatic latent image corresponding to the PWM signal is formed on the surface of the photosensitive body 150.

As described above, the optical sensor 230 emits a synchronization signal when it detects the laser beam. A polygonal mirror motor 345 rotates the polygonal mirror 240, and a polygonal mirror controller 340 controls the polygonal mirror motor 345. A photosensitive body motor 355 rotates the photosensitive body 150, and a photosensitive body controller 350 controls the photosensitive body motor 350.

Figure 4:
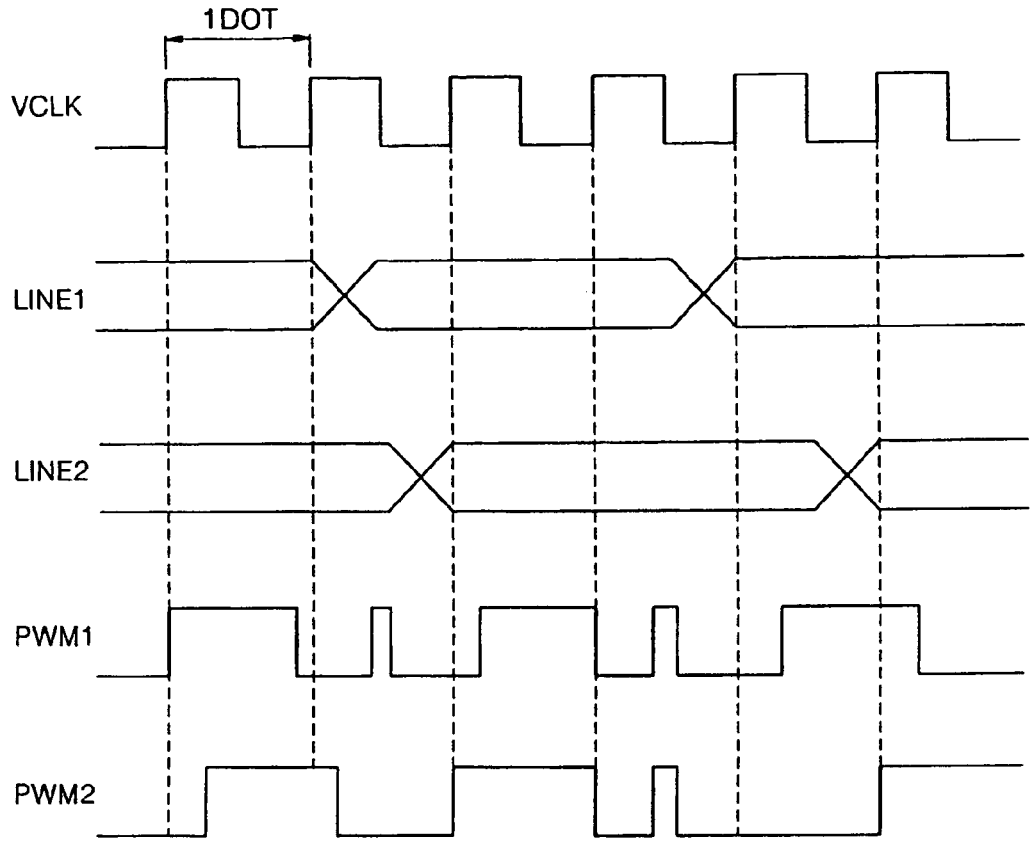
FIG. 4 illustrates a pulse width modulation signal in a medium-resolution mode.

FIG. 4 illustrates PWM signals in a medium-resolution mode.

Referring to FIG. 4, a video clock VCLK is provided as a reference clock for data synchronization. In the medium-resolution mode, one cycle of the video clock VCLK corresponds to one dot. The controller 320 reads first line data LINE1 and second line data LINE2 from the memory module 315. The line data LINE1 and LINE2 are converted into first and second PWM signals PMW1 and PMW2 using the lookup table, respectively. The first PWM signal PWM1 is transmitted to the first laser driver 331 to modulate the first laser beam emitted from the first semiconductor laser 211. The second PWM signal PWM2 is transmitted to the second laser driver 332 to modulate the second laser beam emitted from the second semiconductor laser 212.

Figure 5:
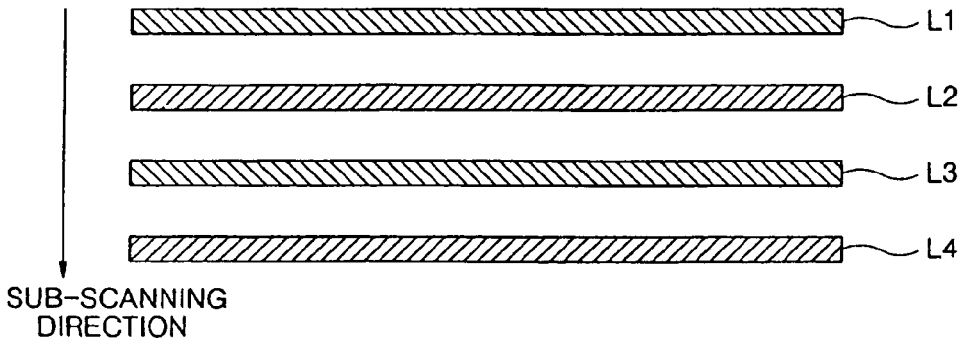
FIG. 5 illustrates main-scanning lines in a medium-resolution mode.

FIG. 5 illustrates main-scanning lines in a medium-resolution mode.

Referring to FIG. 5, the first and the second laser beam form two main-scanning lines L1 and L2, respectively, in the sub-scanning direction, during one scan. That is, two main-scanning lines are formed through one scan. As the photosensitive body continues to move, the first and second laser beams form two more main-scanning lines, L3 and L4, respectively. As two main-scanning lines are formed during each scan, it is possible to form an image about two times faster than the single beam image forming apparatus.

Next, a method of processing high-resolution input image data will be described. High-resolution means a resolution that is n times higher than medium resolution. For simplicity, medium resolution will refer to 600 dpi (dots/inch) and high-resolution will refer to 1200 dpi. A method of doubling resolution will be described below.

In the image forming apparatus having two laser beams, the moving speed of the photosensitive body is halved in order to double the resolution. The moving speed of the photosensitive body is reduced to allow both laser beams to contribute in an overlapping manner to the formation of each main-scanning line.

There is no change in the rotational speed of the polygonal mirror and the frequency of the video clock. The resolution can be increased without any additional expensive circuit for varying the rotational speed of the polygonal mirror and the frequency of the video clock, which would require relatively precise control.

Figure 6:
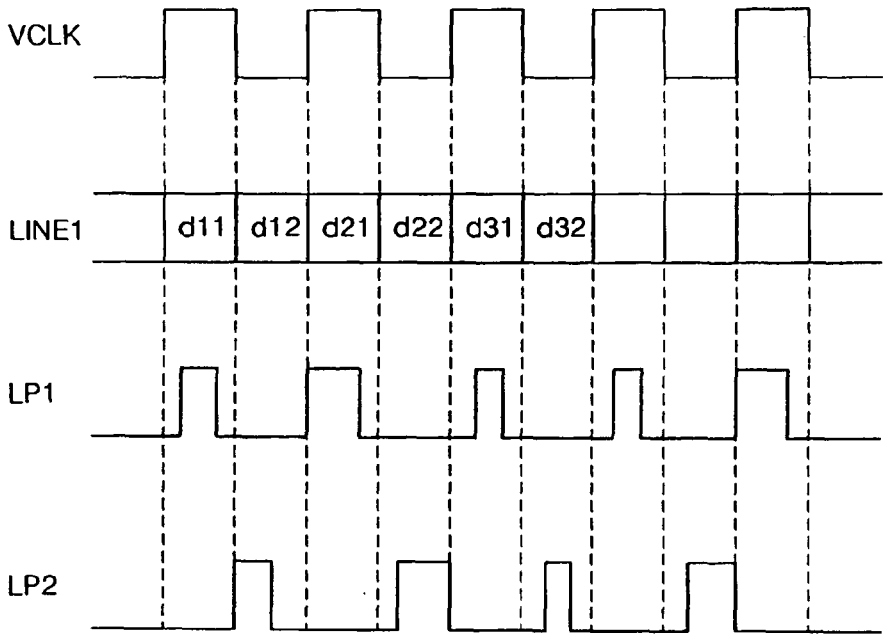
FIG. 6 illustrates pulse width modulation signals in a high-resolution mode.

FIG. 6 illustrates PWM signals in a high-resolution mode.

Referring to FIG. 6, one line data (LINE1) of the high-resolution image data of 1200 dpi contains two data d11 and d12 during one cycle of the video clock VCLK corresponding to 600 dpi. During one cycle of the video clock VCLK, the amount of the high-resolution image data of 1200 dpi is twice the amount corresponding to medium-resolution image data of 600 dpi.

PWM signals are generated after dividing the high-resolution input image data by two. That is, the input data during one cycle of the video clock VCLK is converted in two PWM signals LP1 and LP2, respectively. For example, data d11, d21, d31, etc., of a 2k address of one line data LINE1 of the high-resolution image data are converted into a first PWM signal LP1. And, data d12 d22, d32, etc., of a 2k+1 address of one line data LINE1 are converted into a second PWM signal LP2. In this process, k is a positive integer. The first PWM signal LP1 is transmitted to the first laser driver 331 to modulate the first laser beam emitted from the first semiconductor laser 211. The second PWM signal LP2 is transmitted to the second laser drive 332 to modulate the second laser beam emitted from the second semiconductor laser 212. By overlapping the first laser beam and the second laser beam onto one main-scanning line, the resulting main-scanning line has double resolution.

Figure 7:
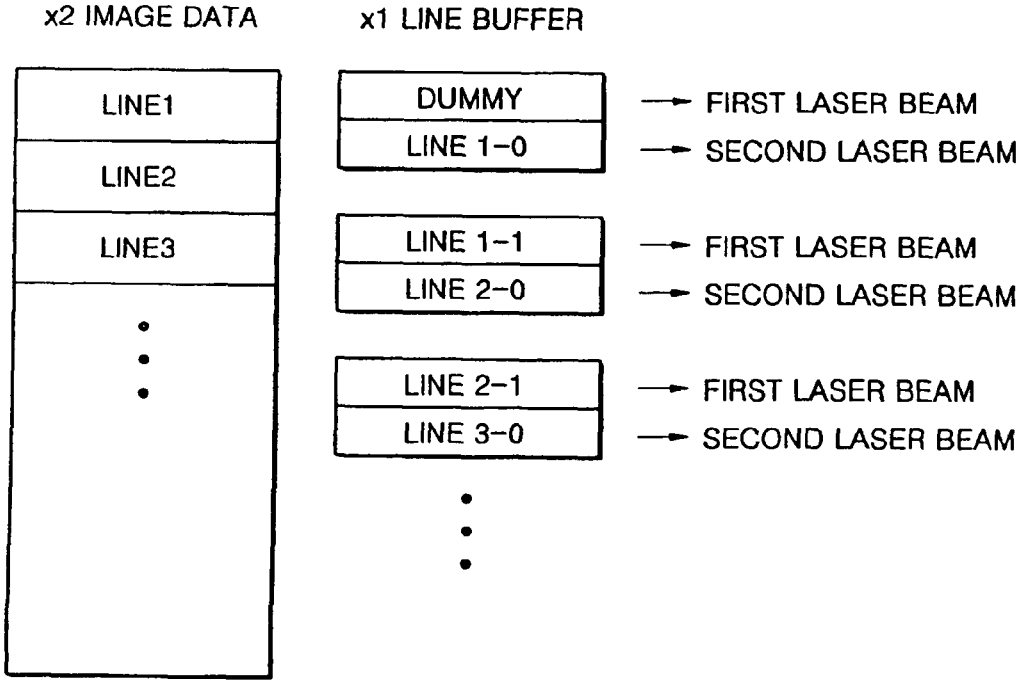
FIG. 7 is a diagram illustrating line buffer management.

FIG. 7 is a diagram illustrating line buffer management. The high-resolution image data is divided into a plurality of medium-resolution image data, and the plurality of medium-resolution image data is stored in line buffers.

Referring to FIG. 7, the respective line data LINE1, LINE2, LINE3, etc., of the high resolution image data can be divided into two pieces of data having medium resolution, i.e., 2k address line data LINE1-0, LINE2-0, etc., and 2k+1 address line data LINE1-1, LINE2-1, etc. For example, the line data LINE1 of the high-resolution image data is divided into the line data LINE1-0 and LINE1-1, and the line data LINE2 of the high-resolution image data is divided into the line data LINE2-0 and LINE2-1. A pair of divided line data are separately converted into PWM signals to be scanned through the two laser beams. The "DUMMY" of FIG. 7 is a temporary line buffer, without any data.

The line buffer of FIG. 7 is only an example for storing the divided line data, and the present general inventive concept is not limited thereto. As another example, the 2k+1 address line data LINE1-1, LINE2-1, etc., may be scanned first, or the last line data of the high-resolution image data may be scanned first.

Figure 8:
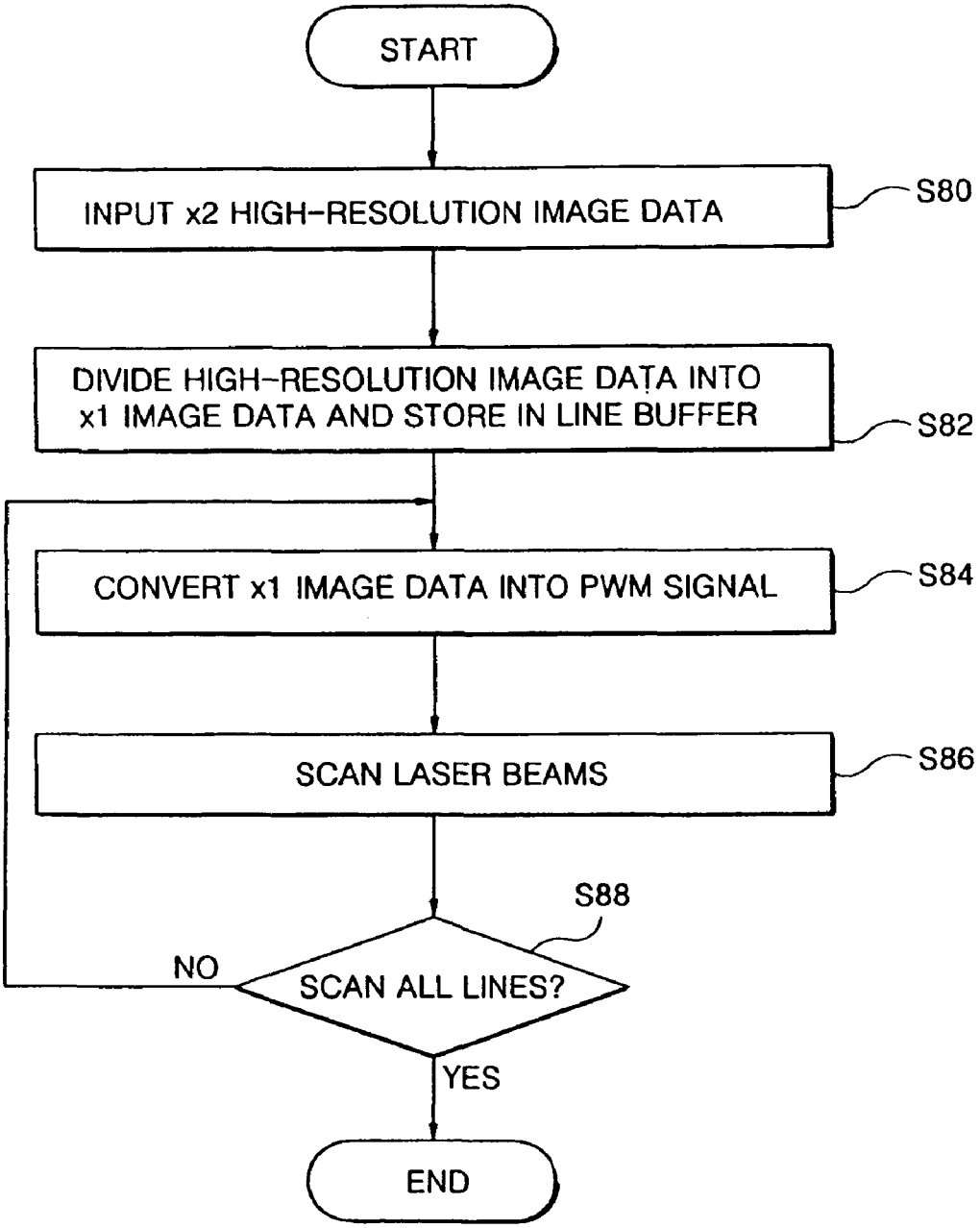
FIG. 8 is a flowchart of an image forming method in accordance with another embodiment of the present general inventive concept.

FIG. 8 is a flowchart of an image forming method in accordance with another embodiment of the present general inventive concept.

Referring to FIG. 8, when high-resolution image data is input (operation S80), the high-resolution image data is divided into a plurality of medium-resolution image data and the medium-resolution image data are stored in a line buffer (operation S82). In this process, medium resolution is the original resolution supported by the image forming apparatus, and high-resolution is two times the medium resolution. The divided medium-resolution image data are converted into PWM signals according to the line data thereof, respectively (operation S84). The PWM signals are transmitted to laser drivers to modulate the laser beams, respectively (operation S86). As a result, a main-scanning line is formed at a surface of a photosensitive body. When all the line data are scanned, the image forming process is completed (operation S88).

Figure 9A:
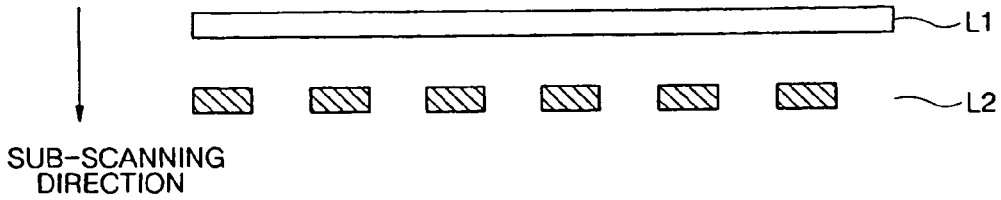
FIGS. 9A to 9C sequentially illustrate the formation of the main-scanning lines on the surface of a photosensitive body using the line buffer of FIG. 7.
Figure 9B:
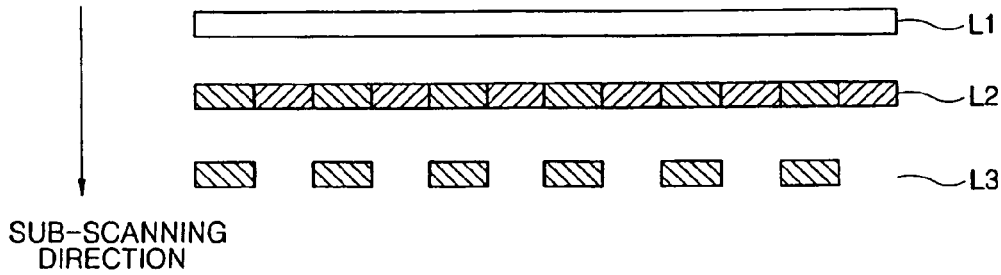
Figure 9C:
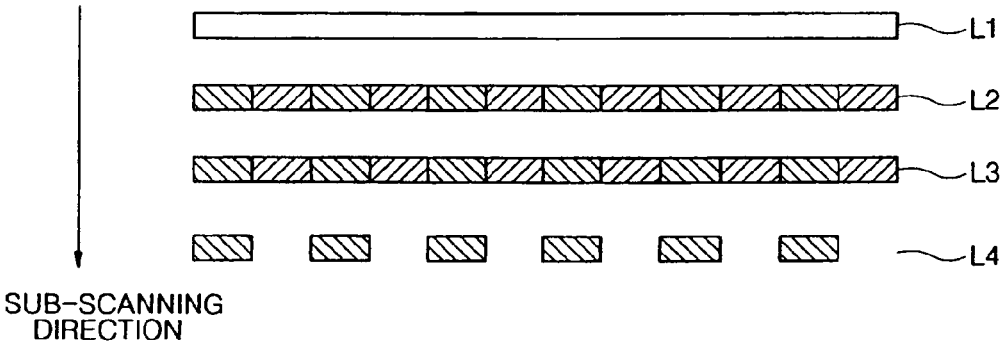

FIGS. 9A to 9C sequentially illustrate the formation of the main-scanning lines on the surface of a photosensitive body using the line buffer of FIG. 7.

According to FIG. 9A, the first and the second laser beams form two main-scanning lines L1 and L2, respectively, in a sub-scanning direction. Here, a dummy line is formed at the first main-scanning line L1, and data of LINE1-0 is scanned onto the second main-scanning line L2.

FIG. 9B illustrates the image forming process after the photosensitive body moves once in the sub-scanning direction, and then the first and second laser beams scan the photosensitive body surface. The first laser beam scans the second main-scanning line L2 in an overlapping manner, and the second laser beam scans the third main-scanning line L3. Since the first laser beam scans data of the data line LINE1-1, eventually the data line LINE1 of the input image data of 1200 dpi is scanned onto the second main-scanning line L2 without any loss of resolution. Data of the data line LINE2-0 is scanned onto the third main-scanning line L3.

FIG. 9C illustrates the image forming process after the photosensitive body moves once more in the sub-scanning direction, and then the first and second laser beams scan the photosensitive body surface. The first laser beam scans the third main-scanning line L3 in an overlapping manner and the second laser beam scans the fourth main-scanning line L4. Since the first laser beam scans data of the data line LINE2-1, eventually, the data line LINE2 of the input image data of 1200 dpi is scanned onto the third main-scanning line L3 without any loss of resolution. Data of the data line LINE3-0 is scanned onto the fourth main-scanning line L4.

As described above, the moving speed of the photosensitive body is reduced in order to double the resolution. The high-resolution image data having two times the medium resolution is divided into two medium-resolution image data. The two laser beams scan each main-scanning line in an alternating and overlapping manner. Therefore, it is possible to form an electrostatic latent image on the photosensitive body for high-resolution input image data without any loss of resolution.

Hereinafter, another embodiment of an image forming apparatus including four laser beams will be described. The present embodiment described below has the same constitution as the previous embodiment except that the light scanning unit includes four semiconductor lasers and laser drivers to drive the four lasers.

The image forming apparatus including four laser beams can quadruple the resolution. For example, if the medium resolution is 600 dpi, the high-resolution can be 2400 dpi. A method of quadrupling the resolution will be described below.

In order to quadruple the resolution, the speed of the photosensitive body is reduced to ¼. Therefore, the four laser beams scan one main-scanning line in an overlapping manner. The higher resolution processing is achieved without having to change the rotational speed of the polygonal mirror and the frequency of the video clock.

Figure 10:
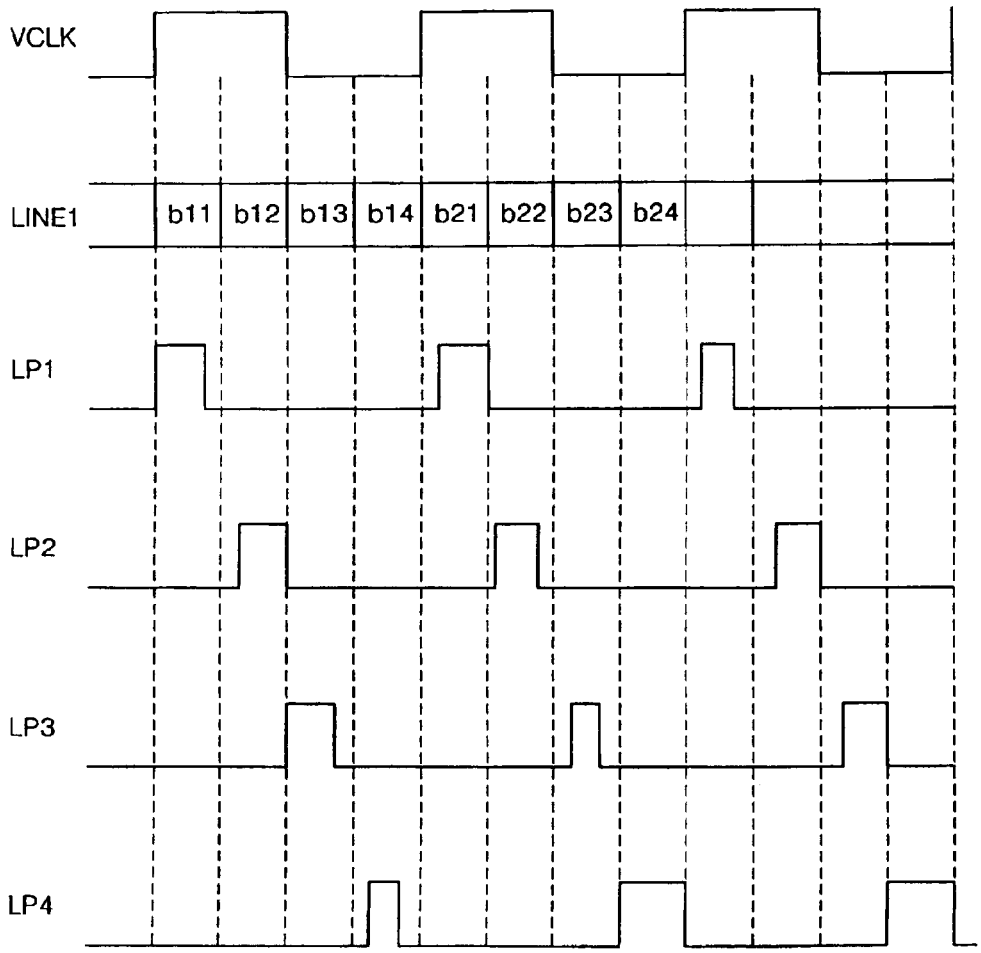
FIG. 10 illustrates pulse width modulation signals in a high-resolution mode.

FIG. 10 illustrates PWM signals in a high-resolution mode.

Referring to FIG. 10, the high-resolution input image data LINE1 having quadruple resolution includes four data pieces b11, b12, b13, and b14 during one cycle of the video clock VCLK.

The high-resolution input image data is divided into four pieces corresponding each to ¼ of the cycle of the video clock VCLK. The four pieces of input data are then converted into PWM signals LP1, LP2, LP3, and LP4 corresponding to the four laser beams. For example, 4k address data b11, b21, etc., of high-resolution are converted into the first PWM signal LP1, 4k+1 address data b12, b22, etc., of high-resolution are converted into the second PWM signal LP2, 4k+2 address data b13, b23, etc., of high-resolution are converted into the third PWM signal LP3, and 4k+3 address data b14, b24, etc., of high-resolution are converted into the fourth PWM signal LP4. In this process, k is a positive integer.

Figure 11:
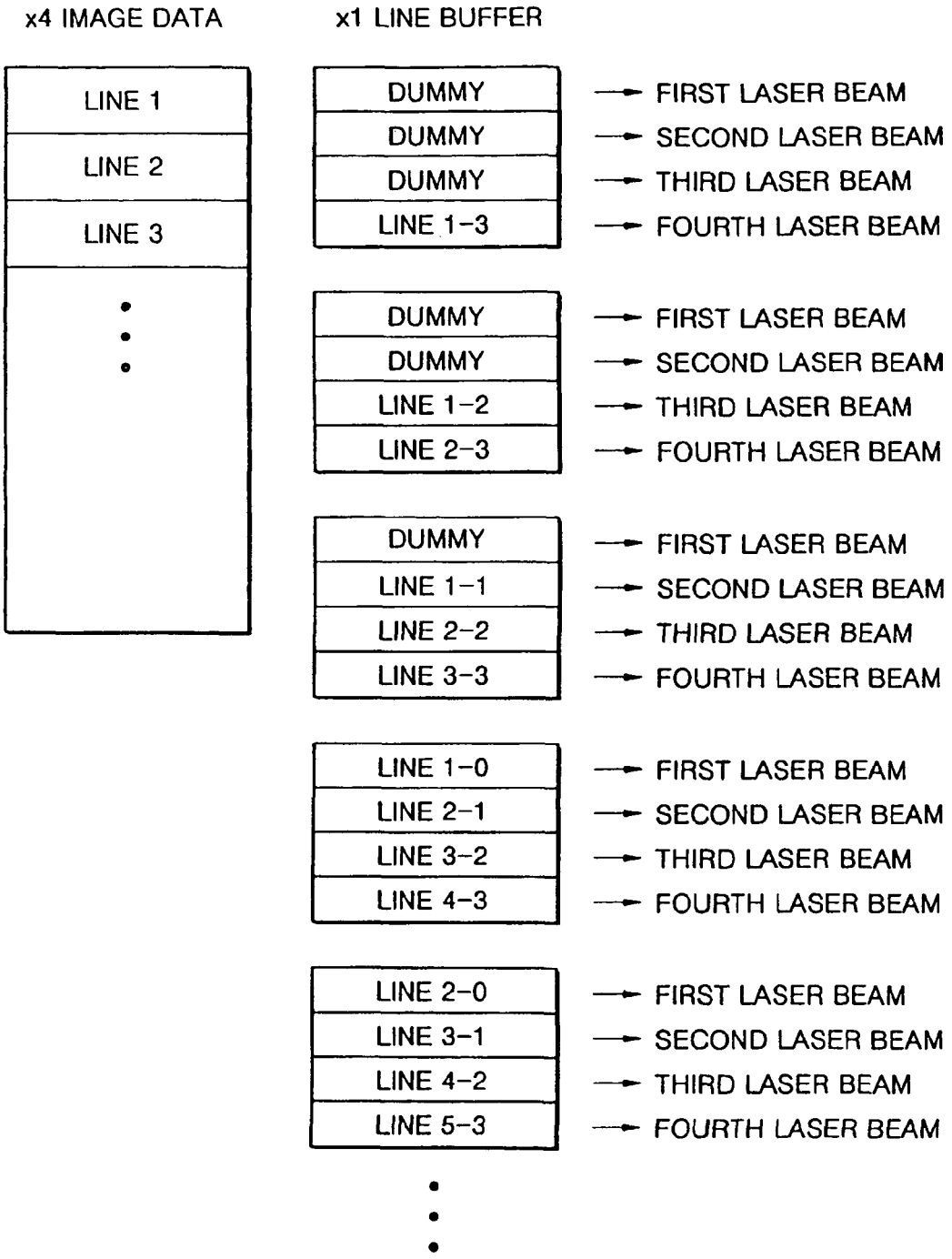
FIG. 11 is a diagram illustrating line buffer management.

FIG. 11 is a diagram illustrating line buffer management.

Referring to FIG. 11, the line data LINE1, LINE2, LINE3, and LINE4 of the high-resolution input image data having quadruple resolution can be divided into 4k address line data LINE1-0, LINE2-0, etc., 4k+1 address line data LINE1-1, LINE2-1, etc., 4k+2 address line data LINE1-2, LINE2-2, etc., and 4k+3 address line data LINE1-3, LINE2-3, etc. The four pieces of line data have medium resolution. For example, the line data LINE1 of the image data of 2400 dpi is divided into four pieces of line data LINE1-0, LINE1-1, LINE1-2, and LINE1-3; the line data LINE2 is divided into four pieces of line data LINE2-0, LINE2-1, LINE2-2 and LINE2-3. A line buffer includes a plurality of sets, each having four pieces of line data. The sets of line data are scanned once by four semiconductor lasers. That is, four pieces of line data are individually converted into PWM signals to modulate the laser beam emitted by the first, the second, the third, and the fourth laser beams, respectively.

FIG. 11 illustrates an example of a line buffer to store divided line data, but the present general inventive concept is not limited thereto. As another example, the 4k address line data LINE1-0, LINE2-0, etc., may be scanned first. Alternatively, the last line data of the high-resolution image data may be scanned first.

FIGS. 12A to 12D sequentially illustrate formation of the main-scanning lines on the surface of the photosensitive body using the line buffer of FIG. 11.

Figure 12A:
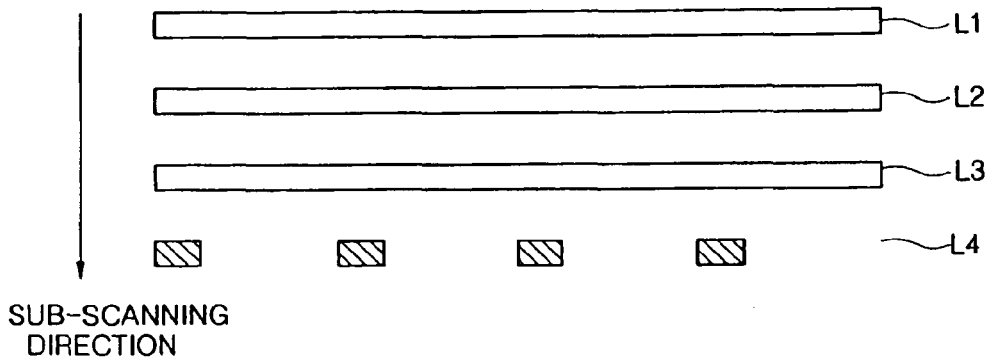
FIGS. 12A to 12D sequentially illustrate the formation of the main-scanning lines on the surface of the photosensitive body using the line buffer of FIG. 11.

Referring to FIG. 12A, firstly, the four laser beams form the four main-scanning lines L1, L2, L3, and L4 in a sub-scanning direction. At this time, dummy lines are formed at the first, second, and third main-scanning lines L1, L2, and L3, and data of the data line LINE1-3 contributes to form the fourth main-scanning line L4.

Figure 12B:
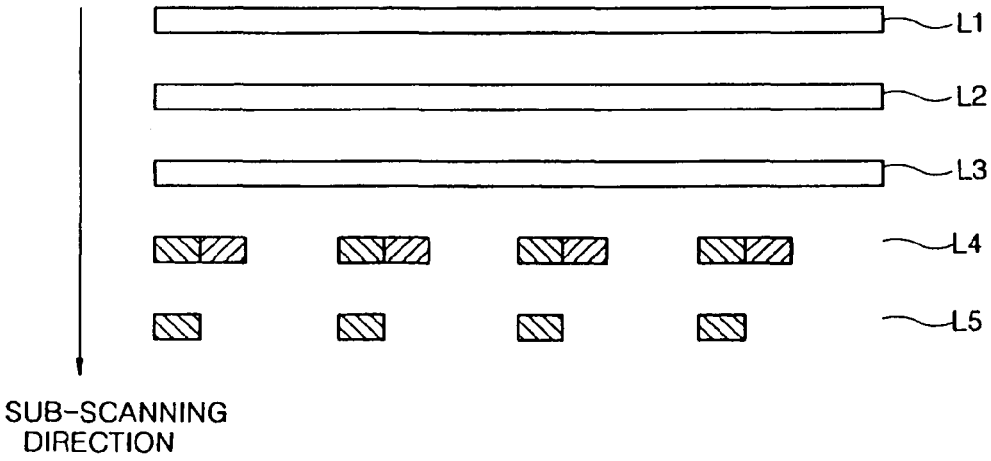

FIG. 12B illustrates the image forming process after the photosensitive body moves once in the sub-scanning direction, and then the laser beams scan the photosensitive body surface. The first laser beam scans the second main-scanning line L2 in an overlapping manner, the second laser beam scans the third main-scanning line L3 in an overlapping manner, the third laser beam scans the fourth main-scanning line L4 in an overlapping manner, and the fourth laser beam scans the fifth main-scanning line L5. Since the third laser beam is modulated according to the line data LINE1-2, eventually, the line data LINE1-2 and LINE1-3 of the high-resolution image data contribute alternately to form the fourth main-scanning line L4. The line data LINE2-3 scans the fifth main-scanning line L5.

Figure 12C:
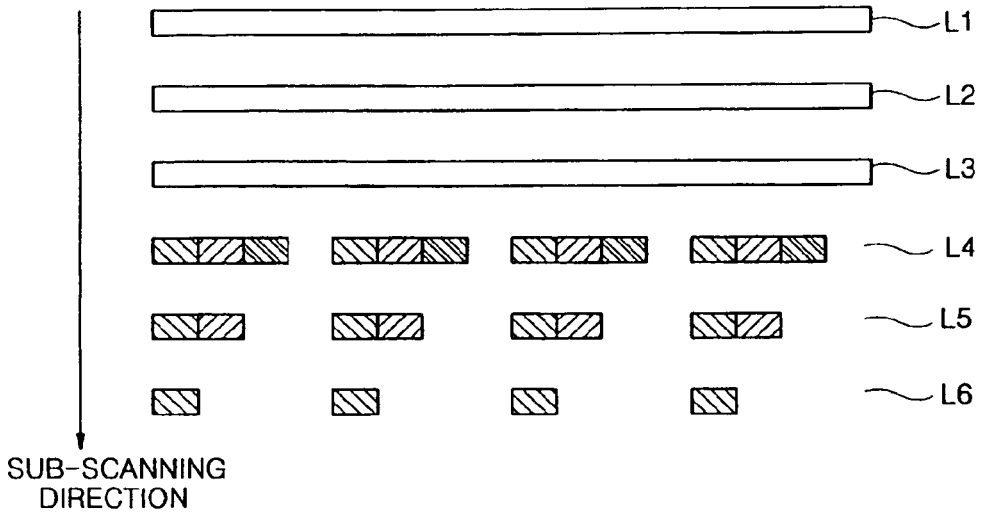

FIG. 12C illustrates the image forming process after the photosensitive body moves once more in the sub-scanning direction, and then the laser beams scan the photosensitive body surface. The first laser beam scans the third main-scanning line L3 in an overlapping manner, the second laser beam scans the fourth main-scanning line L4 in an overlapping manner, the third laser beam scans the fifth main-scanning line L5 in an overlapping manner and the fourth laser beam scans the sixth main-scanning line L6. Since the second laser beam is modulated according to data of the line data LINE1-1, eventually, the line data LINE1-2, LINE1-3, and LINE1-1 of the high-resolution image data alternately contribute to form the fourth main-scanning line L4. Similarly, the line data LINE2-3 and LINE2-2 alternately contribute to form the fifth main-scanning line L5. The line data LINE3-3 contributes to form the sixth main-scanning line L6.

Figure 12D:
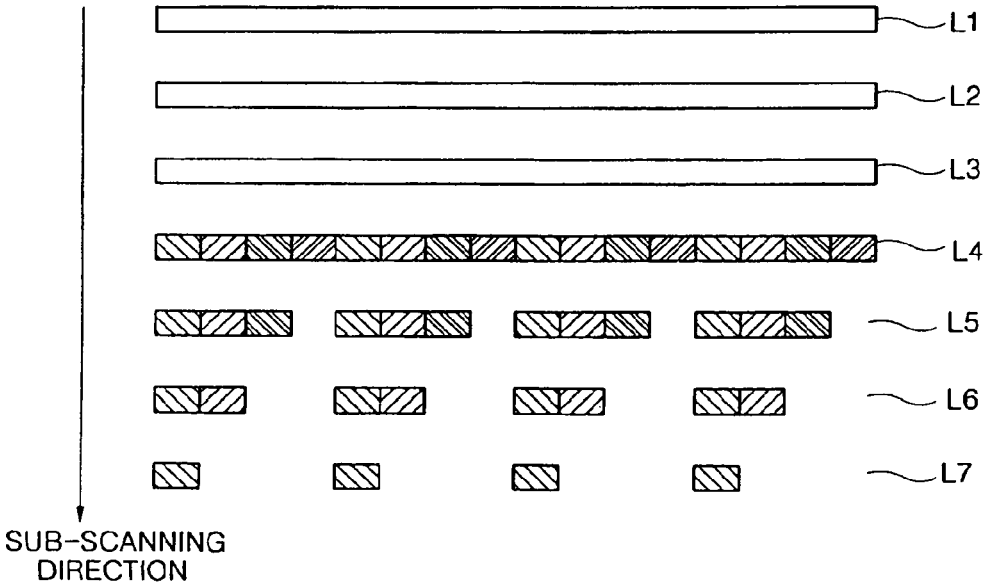

FIG. 12D illustrates the image forming process after the photosensitive body moves once more in the sub-scanning direction, and then the laser beams scan again the photosensitive body surface. The first laser beam scans the fourth main-scanning line L4 in an overlapping manner, the second laser beam scans the fifth main-scanning line L5 in an overlapping manner, the third laser beam scans the sixth main-scanning line L6 in an overlapping manner and the fourth laser beam scans the seventh main-scanning line L7. Since the first laser beam is modulated according to the data of the line data LINE1-0, eventually, the line data LINE1-2, LINE1-3, LINE1-1, and LINE1-0 of the high-resolution image data having quadruple resolution alternately contribute to form the fourth main-scanning line L4. Therefore, the data line LINE1 of the high-resolution image data having quadruple resolution is scanned onto the fourth main-scanning line L4 without any loss of resolution. Since the second laser beam is modulated according to the data of the data line LINE2-1, in the end, the line data LINE2-3, LINE2-2, and LINE2-1 alternately contribute to form the fifth main-scanning line L5. The line data LINE3-3 and LINE3-2 alternately contribute to form the sixth main-scanning line L6. The data line LINE4-3 contributes to form the seventh main-scanning line L7.

In the quadruple resolution mode, the speed of the photosensitive body is reduced to ¼, and the four laser beams contribute to form each main-scanning line in an overlapping manner.

Although the above-described embodiments correspond to double and quadruple resolution, triple, sextuple, or even greater resolution can be obtained by adjusting the number of laser beams and applying the method disclosed above.

As can be seen from the foregoing, it is possible to form a high-resolution image by using a plurality of laser beams to form each main-scanning line in an overlapping manner, without additional devices.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming method comprising:

dividing first image data into a plurality of second image data representing first and second segments of a line each to be scanned over an entire length of a main scanning line in a main scanning direction; and modulating the second image data to generate image signals to correspond to the respective first and second line segments and emitting a plurality of laser beams according to the image signals such that a first laser forms an entire dummy line at a first main-scanning line and a second laser forms data of a second line at a second main-scanning line followed by the plurality of first and second laser beams alternately contributing the first and second line segments in an overlapping manner over the entire length of a main scanning line to form at least one main-scanning line of an electrostatic latent image of the first image data on a photosensitive body.

2. The image forming method according to claim 1, wherein the first image data is divided into the second image data according to addresses of the first image data.

3. The image forming method according to claim 2, wherein the first image data comprises line data and each first image line data corresponds to one main-scanning line of the electrostatic latent image.

4. The image forming method according to claim 1, with at least two laser beams overlapping each other.

5. The image forming method according to claim 4, wherein the laser beams overlap each other in a sequential manner.

6. The image forming method according to claim 1, wherein the plurality of second image data results from dividing the first image data by a divisor $\geqq 2$.

7. An image forming method comprising:

receiving a high resolution input image from a host device;

dividing the high resolution input image into medium resolution line data;

generating a plurality of modulated signals to represent the plurality of medium resolution line data;

driving a first semiconductor laser using one of the plurality of modulated signals to emit a laser beam of a plurality of first line segments over substantially an entire length of a main scanning line on a photosensitive medium; and driving a second semiconductor laser using a second of the plurality of modulated signals to emit a second laser beam of a plurality of second line segments over the substantial entire length of the main scanning line on the photosensitive medium to alternate and overlap with the first line segments over the entire length of the main scanning line to form a high resolution line in the main scanning direction.

8. The image forming method of claim 7, wherein the first and second data line segments are medium resolution.

9. The image forming method of claim 7, further comprising driving the first and second semiconductor lasers to form a plurality of alternated and overlapped high resolution main scanning lines in a sub-scanning direction.

10. An image forming method comprising:

receiving a high resolution input image from a host device;

dividing the high resolution input image into medium resolution line data;

generating a plurality of modulated signals to represent the plurality of medium resolution line data;

driving a first semiconductor laser beam using one of the plurality of modulated signals to emit a laser beam of an entire dummy line at a first main-scanning line and a plurality of first line segments over substantially an entire length of a second main scanning line on a photosensitive medium; and driving a second semiconductor laser beam using a second of the plurality of modulated signals to emit a second laser beam of a plurality of second line segments over the substantial entire length of the second main scanning line on the photosensitive medium to alternate and overlap with the first line segments over the entire length of the second main scanning line to form a high resolution line in the main scanning direction.

11. The image forming method of claim 10, wherein the first and second data line segments are medium resolution.

12. The image forming method of claim 10, further comprising driving the first and second semiconductor laser beams to form a plurality of alternated and overlapped high resolution main scanning lines in a sub-scanning direction.

13. The image forming method of claim 10, wherein the first and second semiconductor laser beams are emitted by respective first and second semiconductor lasers.

* * * * *